United States Patent [19]

Stellmach

[11] 4,118,522

[45] Oct. 3, 1978

[54] METHOD AND DEVICE FOR THE COATING OF TABLETS

[76] Inventor: Bruno Stellmach, Schillerstrasse, 52, 3052 Bad Nenndorf, Fed. Rep. of Germany

[21] Appl. No.: 767,414

[22] Filed: Feb. 10, 1977

Related U.S. Application Data

[63] Continuation-in-part of Ser. No. 461,052, Apr. 15, 1974, abandoned.

[30] Foreign Application Priority Data

Apr. 20, 1973 [DE] Fed. Rep. of Germany ..... 2319960

[51] Int. Cl.[2] ..... B05D 7/00

[52] U.S. Cl. ..... 427/3; 424/35; 427/242; 427/294; 118/6; 118/13; 118/19; 427/425

[58] Field of Search ..... 118/19, 6, 13; 427/2, 427/3, 242, 294, 425; 424/35

[56] References Cited

U.S. PATENT DOCUMENTS 3,390,648 7/1968 Martin ..... 118/19 X

FOREIGN PATENT DOCUMENTS 1,060,093 6/1959 Fed. Rep. of Germany ..... 427/2

*Primary Examiner*—Michael R. Lusignan
*Attorney, Agent, or Firm*—Allison C. Collard

[57] ABSTRACT

For various purposes tablets are often provided with a coating. The coating processes are extremely time-consuming. To reduce the time for the manufacture of dragees the liquid coating material is applied to the tablet kernels in a vacuum.

1 Claim, 2 Drawing Figures

METHOD AND DEVICE FOR THE COATING OF TABLETS

Figure 1:
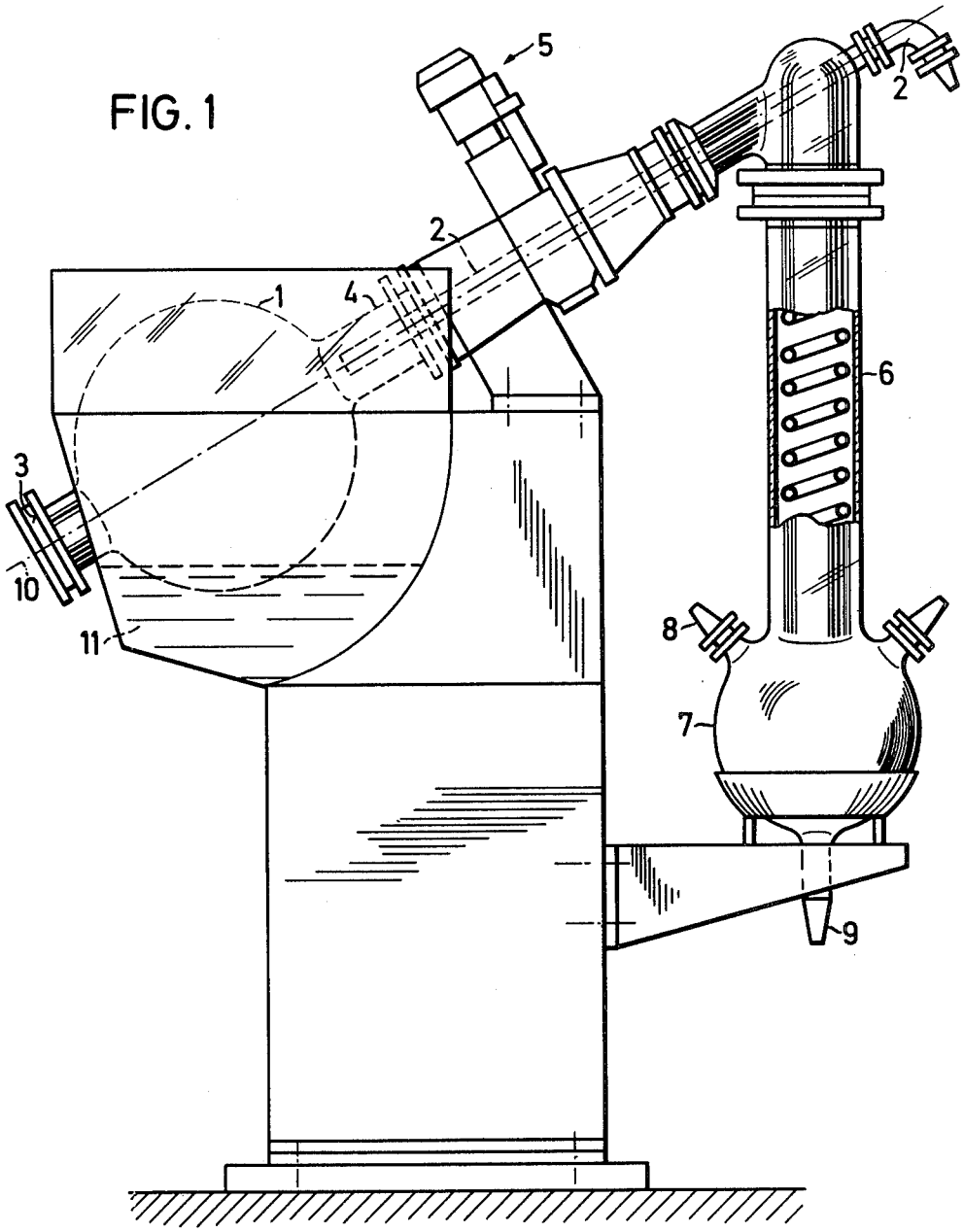

This is a continuation-in-part of prior co-pending application Ser. No. 461,052, filed Apr. 15, 1974, now abandoned.

Tablets are often provided with a coating to obtain a more pleasing appearance and a better taste or to prolong or even prevent the disintegration or dissolution of the tablets in the stomach in order to insure that the absorption of the medicament or the therapeutic effect takes place in the upper portion of the intestinal canal. In the following, this process shall be called coating, and the coated tablets shall be called dragées. This coating process is carried out in coating vats by first applying a small quantity of the coating material to the hard dragée kernel. Although this small quantity of coating material is distributed over the entire surface of the kernels, the latter stick together to some extent. For this reason, the coating material on the kernel is covered with a powder which contains sugar. This prevents the kernels from sticking together, and they can roll freely. The dragées are then dried because remaining moisture can lead to changes in the kernels. The application of the coating material and the sugar-containing powder is then repeated until an adequately thick dragée coating comprising from 30 to 50% of the weight of the kernel has been formed. This can require up to 30 layers. Because the coating process consists of a large number of operations it is extremely time-consuming and requires that several devices be operated simultaneously in order to manufacture a large quantity of dragées per unit time. The process described above has generally been used for a long time, as is indicated in Prof. F. Gstirner's *Einfuhrung in die Arzneibereitung*, 3rd ed. (Stuttgart: Wissenschaftliche Verlagsgesellschaft, 1968).

Copper, tin-plated or plastic vats (coating vats) are used as coating apparatuses. These rotate about an oblique axis, whereby the angle of inclination of the axis and the rotation speed can be varied. A further disadvantage of previous methods and the devices used in accordance with these methods is that the preparatory operations are extremely time-consuming. Before the kernels to be coated are put into the coating vat; the inner metal surface is in many cases coated with a hard sugar coating in order to prevent blacking of the kernels. The vat is then coated by applying several extremely thin layers of gum sirup.

Shortened processes for the manufacture of dragées have already been developed and put into practice to reduce the required time. These include the use of binding agents to reduce the coating time to a few hours and drying the layers by using alcohol additives. A further means of rationalizing the coating process is offered by a method in accordance with which the coating material is applied by spraying instead of being applied in repeated steps. The application of part of the spray suspension is then followed by a warm-air drying operation. Then the suspension or solution is sprayed on again. This operation is continued until the desired coating thickness is obtained. The application of sugar-containing powder, drying in drying chambers and dust removal are eliminated. The occasional sticking together with the ensuing formation of pairs or tablets is however not prevented.

A further spraying method has been developed using a turbulent air process in which the kernels are not coated in a vat but rather in a special apparatus. The principle of this method is that kernels, which are in a cylinder, are held by a strong rising air stream in a suspended rotation and at the same time are sprayed with the coating solution and dried in the warm air.

This method is particularly suited to the lacquering of kernels, while the coating with a sugar solution presents some difficulties.

Another known method is the dry coating of tablets. Unlike the previous process using solutions, this method uses granulated powder. This process requires however expensive special machines.

It is an object of the present invention to provide a method and device for the coating of tablets which, compared with previously known methods and devices, make it possible to obtain a further savings in manufacturing time and an improvement in the quality of the final product through the use of technically simple means. In accordance with the present invention, the coating material is applied to the kernel of the tablet in a vacuum. Appreciably shorter coating times are obtained by a faster drying operation in a vacuum. This result in a higher output than with known coating processes in a coating vat of the same size so that it is possible to use fewer production units and so that less space is taken up in the production plant. Coating in a vacuum also yields a final product of better quality. A reduction in rejection due to the elimination of the formation of pairs and the sticking together contributes to greater productivity in the manufacturing process. Coating operations which had to be performed by coating specialists up to now can now be carried out by any laboratory worker. A rotating evaporator is an especially advantageous device, the evaporation flask of which functions as a coating vat, the entry tube of which functions as a means of introducing the coating material, and the receiving flask of which serves to collect the solvent to be reused in the coating material. It is further suggested in accordance with the preferred embodiment of the present invention that the openings of the previously common coating vats out of metal (steel vats, etc.) also be provided with a transparent vacuum-tight seal and that the driving shaft be constructed as a hollow shaft. The exterior end of the hollow shaft may be connected with a cooler and a receiving vessel by means of a slip-ring seal. The coating solution is then introduced as described above.

The use of a rotating evaporator in accordance with the present invention renders possible the extremely even application of the coating suspension without the extensive use of spraying apparatuses so that there is no rejection entailed because of sticking together or pairing of the dragees. It is possible to employ solutions for the use of which expensive explosion-proof apparatuses would otherwise be prescribed or which have extremely annoying odors or even characteristics which are injurious to health, e.g. alcohol, chloroform, carbon tetrachloride, etc. The use of these chemicals is made possible without difficulty because the apparatus is closed and the coating process takes place in a vacuum. It is also impossible for dust to penetrate the coating vessel. It is further possible to recover expensive solvents in special coating solutions. Because no expensive metering pumps are necessary, the expenditure for apparatus is appreciably lower than previously.

It is possible to heat or cool the kernels to be coated without any great difficulty, for instance, by means of a liquid bath (oil bath, warm or cold air, etc.) in which the evaporation flask rotates. This also makes it possible to coat tablets comprised of heat-sensitive substances outside air-conditioned rooms. Germ-free coating, which has recently become necessary, is possible in a particularly simple manner, as the rotating evaporation flask consists of one closed apparatus system with entrance and receiving vessel included.

Figure 2:
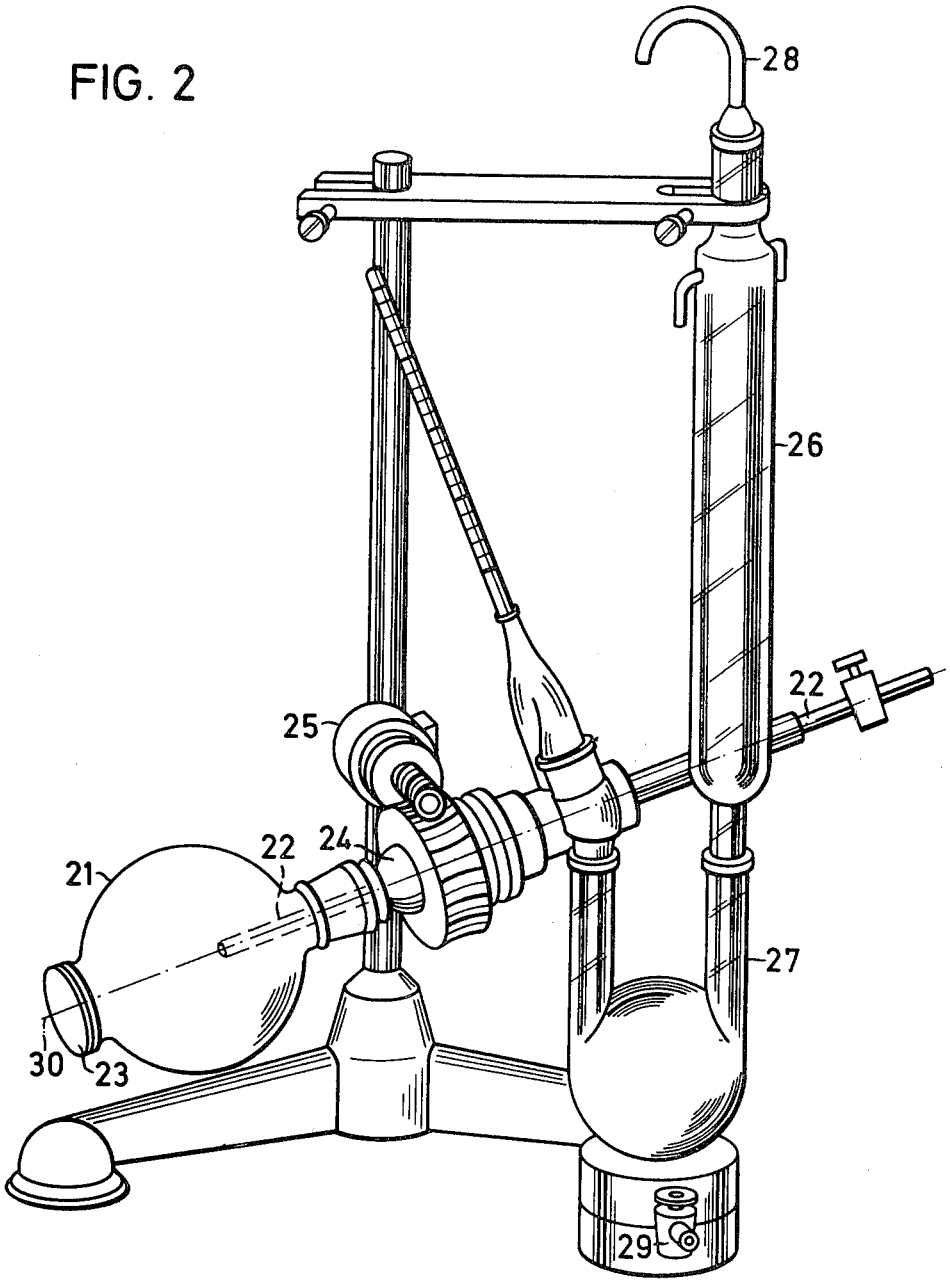

The following drawings schematically represent and illustrate two possible embodiments of the present invention for the use of the method in accordance with the present invention, in which:

FIG. 1 is a side view of a device embodying the present invention with an evaporation flask in a liquid bath; and FIG. 2 is a device embodying the present invention which can be optionally used with a water or oil bath.

The coating suspension comprising a solvent and a solid coating material, preferably a sugar containing material, is sprayed into the evaporation flask 1 by means of an entry tube 2. The rear end of the evaporation flask 1 is provided with a closable emptying opening 3. The evaporation flask 1 is driven by the driving means 5 by means of the hollow shaft 4. The forward end of the hollow shaft, connected by means of a slip-ring seal, empties into a cooler 6, the lower end of the cooler bearing a receiving flask 7. The receiving flask 7 is provided with the connections 8 for the creation of the vacuum and 9 for the removal of the collected solvent. The axis of rotation 10 of the evaporation flask manifests a fixed angle of inclination or an angle of inclination which can be adjusted by changing the connection to the cooler in FIG. 1 by means of a vacuum siphon. The lower portion of the evaporation flask 1 is submerged in a liquid or air bath 11 for the purpose of either warming or cooling its contents.

The device embodying the present invention shown in FIG. 2 can be optionally employed with or without a water bath. The volume of its evaporation flask 21 is less than that of the device in accordance with FIG. 1. Analogously to the details of the embodiment of the present invention in accordance with FIG. 1, the parts of the embodiment in accordance with FIG. 2 bear the further reference numerals 21 for the evaporation flask, 22 for the entry tube, 23 for the emptying opening of the evaporation flask, 24 for the hollow shaft, 25 for the driving means, 26 for the for the receiving flask, 28 for the evacuation connection, 29 for the emptying connection for the receiving vessel, and 30 for the inclined axis of rotation.

The tablet kernels are first introduced into the evaporation flask by means of the closable emptying opening 3 or 23 respectively. The air can then be evacuated from the evaporation flask by means of the evacuation connection. A low vacuum of about 1 mm Hg generally suffices for coating the pills. During operation, that is while the evaporation flask is rotating, the coating suspension is sprayed by means of the entry tube 2 or 22 respectively, to successively apply several layers of the coating material on the tablets. The drying operation is considerably facilitated by the vacuum which is partially assisted by additional warming. The vaporized solvent condenses in the cooler and is collected by the receiving vesssel. The solent can be removed by means of the emptying connection 29 and reused again if necessary.

It should be appreciated that, copper, tin-plated or plastic coating vats well known in the art and formerly employed as coating apparatus may be suitably adapted to for use in connecting with the novel method and apparatus herein described. They, of course, must be provided with a vacuum-tight closing means.

What is claimed is:

1. A method of coating medicinal tablets comprising the steps of:

introducing the tablets into a rotatable evaporating vessel;

Evacuating said vessel to establish a vacuum therein of about 1 mmHg;

rotating said vessel; and spraying a suspension comprising a solvent and a sugar-containing solid coating material onto said tablets, while said vessel is rotated and subject to said vaccum, to effect successive application of a plurality of thin, sugar-containing films on said tablets, and recovering said solvent for reuse as part of the coating suspension.

* * * * *